US008251413B2

(12) United States Patent
Ramsauer

(10) Patent No.: US 8,251,413 B2
(45) Date of Patent: Aug. 28, 2012

(54) ADJUSTABLE BAR GUIDE

(75) Inventor: Dieter Ramsauer, Schwelm (DE)

(73) Assignee: DIRAK Dieter Ramsauer Konstruktionselemente GmbH, Ennepetal (DE)

( * ) Notice: Subject to any disclaimer, the term of this patent is extended or adjusted under 35 U.S.C. 154(b) by 201 days.

(21) Appl. No.: 12/595,431

(22) PCT Filed: Apr. 14, 2008

(86) PCT No.: PCT/EP2008/002934
§ 371 (c)(1),
(2), (4) Date: Oct. 9, 2009

(87) PCT Pub. No.: WO2008/125318
PCT Pub. Date: Oct. 23, 2008

(65) Prior Publication Data

US 2010/0201136 A1 Aug. 12, 2010

(30) Foreign Application Priority Data

Apr. 14, 2007 (DE) ..... 20 2007 005 424 U

(51) Int. Cl.
*E05C 17/02* (2006.01)
*E05C 5/04* (2006.01)

(52) U.S. Cl. ..... 292/305; 292/251; 292/256; 292/300; 292/341.18

(58) Field of Classification Search ..... 292/340, 292/341, 341.15, 341.18, 301, 291, 293, 292/294, 279, 256.73, 256, 176, 149, 155, 292/251, 256.71, 289, 305, 306, 341.12, 292/341.13, 259 R, DIG. 53, DIG. 56, DIG. 64, 292/DIG. 73
See application file for complete search history.

(56) References Cited

U.S. PATENT DOCUMENTS

| | | | | | |
|---|---|---|---|---|---|
| 476,037 | A | * | 5/1892 | Colton | 292/305 |
| 3,695,657 | A | * | 10/1972 | Rosen | 292/57 |
| 3,756,641 | A | * | 9/1973 | Dugan | 292/258 |
| 3,937,585 | A | * | 2/1976 | Cattermole | 403/300 |
| 3,968,985 | A | * | 7/1976 | Nielsen et al. | 292/340 |
| 3,975,041 | A | * | 8/1976 | Edison | 292/258 |
| 3,984,135 | A | * | 10/1976 | Dathe et al. | 292/4 |
| 4,113,293 | A | * | 9/1978 | Paquette | 292/341.18 |
| 4,148,508 | A | * | 4/1979 | Adair | 292/258 |
| 4,192,537 | A | * | 3/1980 | Laine | 292/264 |
| 4,930,325 | A | * | 6/1990 | Ramsauer | 70/209 |

(Continued)

FOREIGN PATENT DOCUMENTS

DE 2319315 10/1974

(Continued)

*Primary Examiner* — Thomas Beach
*Assistant Examiner* — Alyson M Merlino
(74) *Attorney, Agent, or Firm* — Formmer Lawrence & Haug LLP

(57) ABSTRACT

A bar guide for guiding locking bars on sheet metal cabinet doors, or the like, comprises a carrier which can be secured, e.g., spot welded, to the inside surface of the door leaf and a guide element which can be mounted on the carrier and which has a guide surface whose distance from the inside surface of the door leaf is adjustable. According to the invention, the carrier which is spot welded to the door leaf is a pin with a circumferential thread, and an adjusting screw or adjusting nut can be screwed, or is screwed, on this pin. The guide element is a housing which encloses the adjusting screw and which has a guide channel forming the guide surface for the locking bar.

10 Claims, 11 Drawing Sheets

U.S. PATENT DOCUMENTS

| | | | | |
|---|---|---|---|---|
| 4,998,757 | A * | 3/1991 | Ramsauer | 292/39 |
| 5,039,143 | A * | 8/1991 | Ramsauer | 292/39 |
| 5,044,677 | A * | 9/1991 | Ramsauer | 292/39 |
| 5,284,371 | A * | 2/1994 | Richardson et al. | 292/149 |
| 5,663,011 | A * | 9/1997 | Bunyea et al. | 429/97 |
| 5,779,288 | A * | 7/1998 | Amelio | 292/251 |
| 5,887,915 | A * | 3/1999 | Ramsauer | 292/160 |
| 5,911,664 | A * | 6/1999 | Masters et al. | 52/698 |
| 6,007,119 | A * | 12/1999 | Roth et al. | 292/251.5 |
| 6,086,121 | A * | 7/2000 | Buckland | 292/34 |
| 6,394,510 | B1 * | 5/2002 | Stewart, III | 292/288 |
| 6,915,670 | B2 * | 7/2005 | Gogel | 70/32 |
| 7,311,339 | B2 * | 12/2007 | Lau et al. | 292/128 |
| 2008/0166202 | A1 * | 7/2008 | Dunlap et al. | 411/353 |
| 2010/0143066 | A1 * | 6/2010 | Ramsauer et al. | 411/116 |

FOREIGN PATENT DOCUMENTS

| | | | |
|---|---|---|---|
| DE | 9207267 | | 9/1993 |
| DE | 202005015135 | | 2/2007 |
| EP | 0035175 | | 9/1981 |
| EP | 0454077 | | 10/1991 |
| EP | 1045098 | | 10/2000 |
| EP | 1683937 | | 7/2006 |
| EP | 1683937 | A1 * | 7/2006 |

* cited by examiner

Fig. 1C
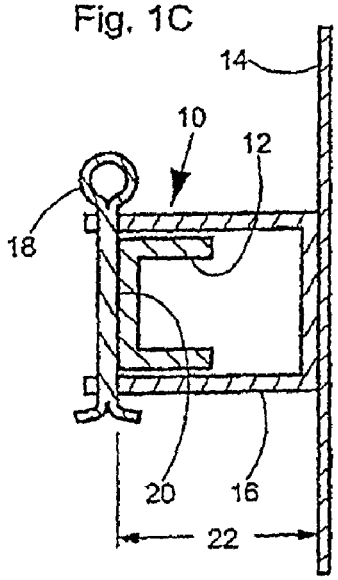
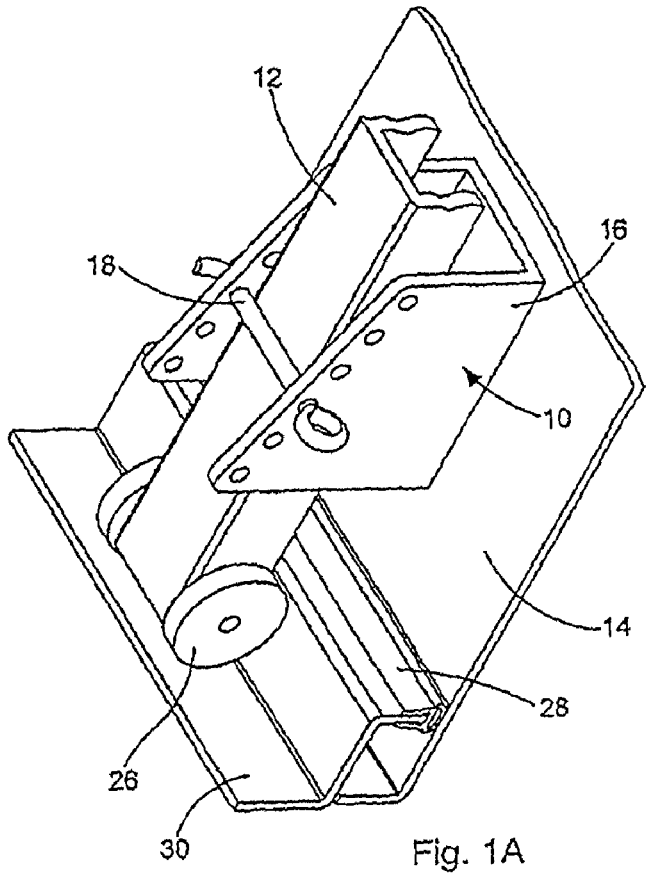
Fig. 1A
Prior Art
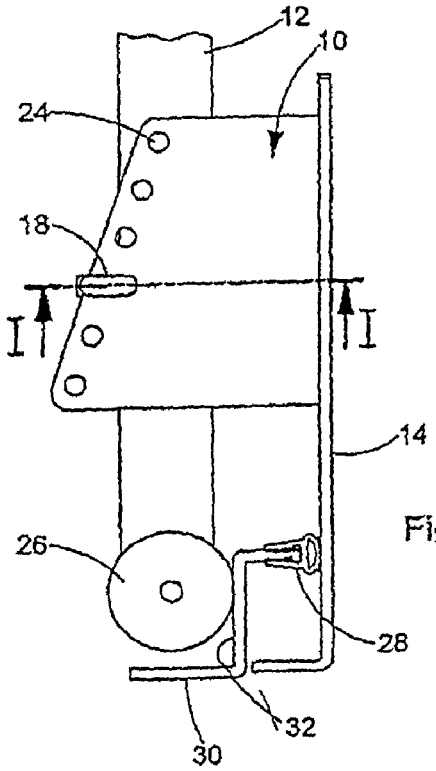
Fig. 1B

ADJUSTABLE BAR GUIDE

The present application claims priority from PCT Patent Application No. PCT/EP2008/002934 filed on Apr. 14, 2008, which claims priority from German Patent Application No. 20 2007 005 424.6 filed on Apr. 14, 2007, the disclosure of which is incorporated herein by reference in its entirety.

BACKGROUND OF THE INVENTION

1. Field of the Invention

The invention is directed to a bar guide for guiding locking bars on sheet metal cabinet doors, or the like, comprising a carrier which can be secured, e.g., spot welded, to the inside surface of the door leaf and a guide element which can be mounted on the carrier and which has a guide surface which faces the door leaf, and the distance of the guide surface from the inside surface of the door leaf is adjustable.

2. Description of Related Art

A plastic bar guide having the features mentioned above is already known from EP 0 035 715 B1. It is a drawback that the entire bar guide on the carrier (stud bolt with thread) must be turned in order to adjust the distance of the bar from the inside surface of the door leaf. This is only possible by disassembling the bar.

A bar guide which allows the distance of the bar from the door leaf to be adjusted by means of grooves is described in connection with a bar lock in Utility Model Document G 92 07 267.4, e.g., on page 6, last paragraph, and page 7, first paragraph. An embodiment form of this arrangement is shown in FIGS. 6A to 6C of this document.

Further, the present applicant is familiar with prior art shown in FIGS. 1A to 1C. As can be seen from the drawings, for purposes of guiding locking bars on sheet metal cabinet doors, or the like, the bar guide comprises a carrier which can be secured, i.e., spot welded, to the inside surface of the door leaf. The carrier is constructed as a U-shaped part, or stud bolt as conceived in Utility Model Document 92 07 267.4, and is provided with a guide element which can be mounted on the carrier and which, in the present case, is in the form of a cotter pin which is inserted through holes arranged at various distances from the door leaf plane. The distance can be adjusted in steps by selecting the pair of holes through which the cotter pin is inserted. While only two distance steps are shown in the prior art according to the Utility Model Document, a total of six pairs of holes are provided in the construction shown in FIGS. 1A to 1C, so that there are six possible distances.

SUMMARY OF THE INVENTION

It is the object of the invention to make possible a finer gradation of steps and to provide a novel configuration of the construction generally.

The above-stated object is met in that the carrier which is spot welded to the door leaf is a pin with a circumferential thread similar to that in the Utility Model Document, and an adjusting screw can be screwed, or is screwed, on this pin, and in that the guide element is a housing which encloses the adjusting screw and which has a guide channel forming the guide surface for the locking bar. The adjusting screw which can be screwed on the pin makes it possible to adjust the distance virtually continuously instead of by steps as in the prior art. Further, the shape of the novel bar guide is more attractive and there is no risk of injury to a user or installer due to protruding parts such as, e.g., the cotter pin according to FIG. 1A.

According to a further development of the invention, the adjusting screw has a head and a shaft adjoining the head and having a reduced diameter and an axial threaded through-hole or blind hole for receiving the pin, wherein the head can be received by a bore hole in the housing and is supported on a shoulder formed by the housing, this shoulder being formed by the diameter reduction of the bore hole. This is a particularly advantageous design.

According to a further development, the shaft of the adjusting screw can be overdimensioned with respect to the area of the bore hole with the diameter reduction in such a way that the adjusting screw is self-retaining with respect to rotation in the bore hole. This obviates the need for other locking means which would otherwise be needed to prevent unwanted displacement of the screw.

A retaining ring can be provided near the end of the shaft and—together with the shoulder—prevents axial movement of the adjusting screw in the housing.

A second bore hole perpendicular to the bore hole for the adjusting screw is provided in the housing next to the bore hole for the adjusting screw for receiving the round or rectangular locking bar in a sliding manner.

The adjusting screw can have a head and a shaft with a reduced diameter adjoining the head and an axial threaded through-hole or blind hole for receiving the pin, wherein the shaft can be received by a bore hole in the housing and is supported on a shoulder formed by the housing, which shoulder is formed by the diameter reduction of the bore hole or, alternatively, the head is supported on the surface of the housing.

Therefore, the retaining ring and shoulder provide for limiting the axial movement and, therefore, the height of the bar guide above the plane of the door leaf. Accordingly, the distance of the alignment roller or alignment slide, for example, is also fixed so that the door closes smoothly.

According to another embodiment form, the pin is surrounded by a helical pressure spring which is supported on the inside surface of the door leaf on the one hand and at the housing on the other hand. The arrangement of a retaining ring can then be dispensed with.

The housing in the area of the spring support can have an annular projection or recess for receiving the end of the spring in a clamping manner so that the spring part cannot be lost so easily before it is mounted.

The adjusting screw can be enclosed by a housing, and tongues anchored at a shoulder formed by the adjusting screw by a diameter reduction proceed from the housing so as to prevent an axial relative movement of the housing on the adjusting nut.

The housing can be injection molded from plastic, and the tongues can then be injection molded integral with the housing.

BRIEF DESCRIPTION OF THE DRAWINGS

FIG. 1A shows a perspective view of a bar guide known to the present applicant;

FIG. 1B shows a side view of the bar guide from FIG. 1A;

FIG. 1C shows a cross-sectional view of the bar guide from FIG. 1A;

DETAILED DESCRIPTION OF EMBODIMENTS

Figure 2A:
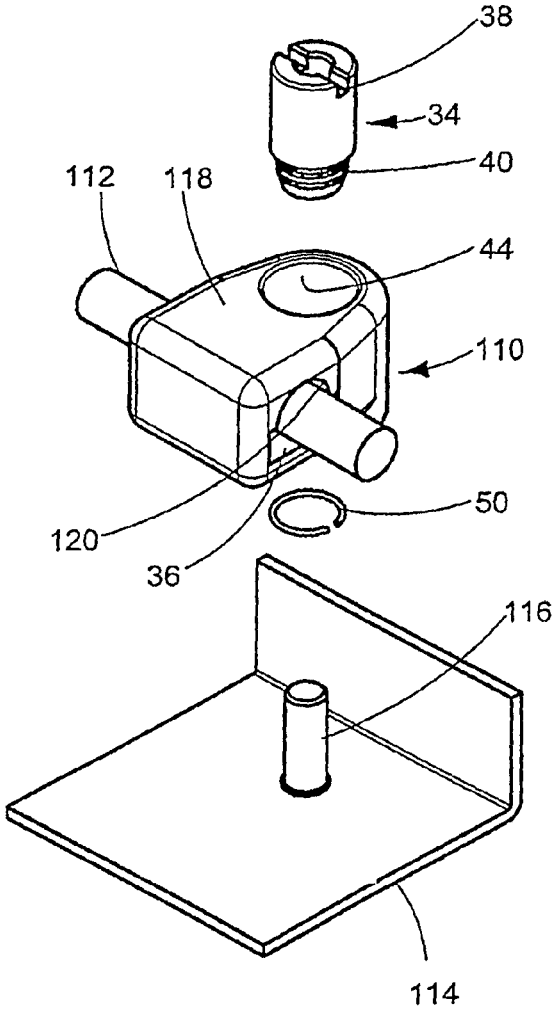
FIG. 2A shows an exploded view of a bar guide mounted at a greater distance from the door leaf.
Figure 2B:
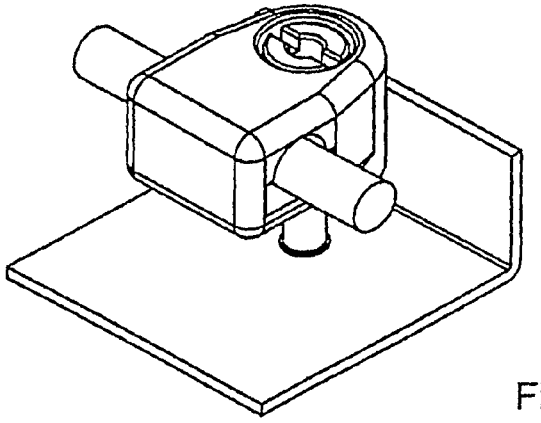
FIG. 2B shows a perspective view of the assembled bar guide from FIG. 2A.

It is to be understood that the figures and descriptions of the present invention have been simplified to illustrate elements that are relevant for a clear understanding of the present invention, while eliminating, for purposes of clarity, many other elements which are conventional in this art. Those of ordinary skill in the art will recognize that other elements are desirable for implementing the present invention. However, because such elements are well known in the art, and because they do not facilitate a better understanding of the present invention, a discussion of such elements is not provided herein.

The present invention will now be described in detail on the basis of exemplary embodiments.

FIG. 1A shows a known 10 guide for a locking bar 12 on a sheet metal cabinet door 14 comprising a carrier 16 which can be secured, e.g., spot welded, to the inside surface of the door leaf and which is constructed as a U-shaped part in this instance, and comprising a guide element 18 which can be mounted on the carrier 16 and which has a guide surface 20 which faces the door leaf 14 and whose distance 22 from the inside surface of the door leaf 14 is adjustable (see FIG. 1B which shows a side view of the arrangement and FIG. 1C which shows a sectional view along the section line indicated by arrow I-I). As is shown particularly in FIGS. 1A and 1B, there are different distances 22 depending on which of the hole pairs 24 is selected for insertion of the cotter pin 18.

In this way, it is possible, for example, to adjust the distance of the alignment roller 26 from the door leaf 14 in such a way that when the locking bar 12 slides down the alignment roller 26 runs without problems on the rear-engagement surface 32 of the door frame 30 with seal 28 and tightly presses the seal against the door leaf 14.

If another seal 28 is used, for example, a thicker seal, the cotter pin 18 could be pulled out of the current hole and inserted into one of the holes at a greater distance from the door leaf so that the locking bar 12 contacting the cotter pin 18 is at a greater distance from the door leaf 14.

FIGS. 2A to 2F show a bar guide which is constructed according to the invention comprising a bar guide 110 for guiding locking bars 112 on a sheet metal cabinet door 114, or the like, comprising a carrier 116 which is secured, e.g., spot welded, to the inside surface of the door leaf 114 and with a guide element 118 which can be mounted, or is mounted, on the carrier 116 and which has a guide surface 120 whose distance 122 from the inside surface of the door leaf 114 is adjustable. According to the invention, the carrier 116 which is spot welded to the door leaf 114 is a pin with a circumferential thread on which an adjusting screw or adjusting nut can be screwed, or is screwed, and the guide element 118 is a housing which encloses the adjusting screw 34 and which has a guide channel 36 forming the guide surface 120 for the locking bar 112.

As can be seen from the exploded view in FIG. 2A, the adjusting screw 34 comprises a head 38 and a shaft 40 adjoining the head 38 and having a reduced diameter in relation to the head (see FIG. 2D) and an axial threaded through-hole or blind hole 42 for receiving the pin 116. The head 38 can be received by a bore hole 44 in the housing 118 and is supported on a shoulder 46 formed by the housing 118, this shoulder 46 being formed by the diameter reduction of the bore hole 44.

The shaft 40 of the adjusting screw 34 can be overdimensioned with respect to the area 48 of the bore hole with the diameter reduction in such a way that the adjusting screw 34 or adjusting nut 34 is self-retaining with respect to rotation in the bore hole 44, so that there is no risk that the position of the bar guide casing 110 will change, for example, when the arrangement is exposed to vibrations.

A retaining ring 50 can be provided near the end of the shaft in a corresponding annular groove in the shaft 40 of the adjusting screw or adjusting nut 34 so as to contact the lower edge of the bore hole 44 and—together with the shoulder 46—prevents axial movement of the adjusting screw 34 in the housing.

A second bore hole 136 perpendicular to the bore hole 44 for the adjusting screw 34 is provided in the housing 110 next to the bore hole 44 for the adjusting screw 34 for receiving the round or rectangular locking bar 112 in a sliding manner.

Owing to the fact that the adjusting nut or adjusting screw 34 is not movable axially with respect to the housing or block 52 but can be rotated, the adjusting screw is displaced when rotated, for which purpose it can have a slot 54 to which a turning tool such as a screwdriver can be applied. When the adjusting screw is displaced on the external thread of the welded stud 116, it moves along with the block 52, e.g., out of the position shown in FIG. 2D at a distance 122 into the position according to FIG. 2F located at a shorter distance.

Figure 2D:
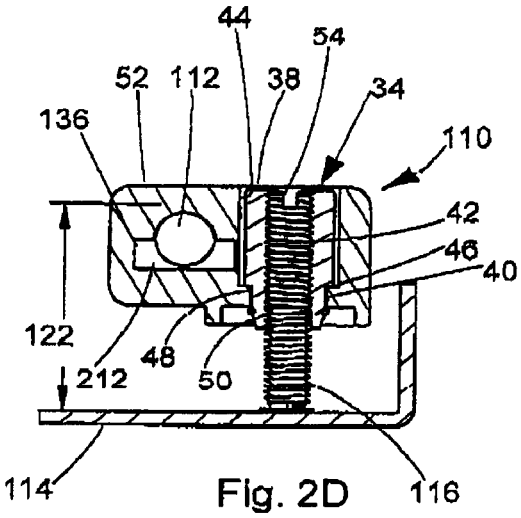
FIG. 2D shows a sectional view of the bar guide from FIG. 2A.
Figure 2F:
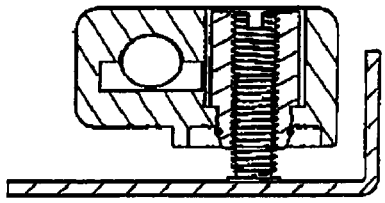
FIG. 2F shows a cross-sectional view of the bar guide from FIG. 2E.
Figure 2C:
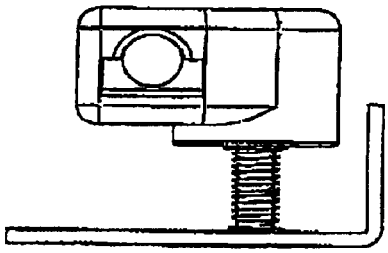
FIG. 2C shows a plan view of the bar guide from FIG. 2A.
Figure 2E:
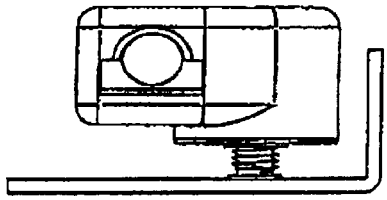
FIG. 2E shows a plan view of a bar guide at a shorter distance from the door.
Figure 3A:
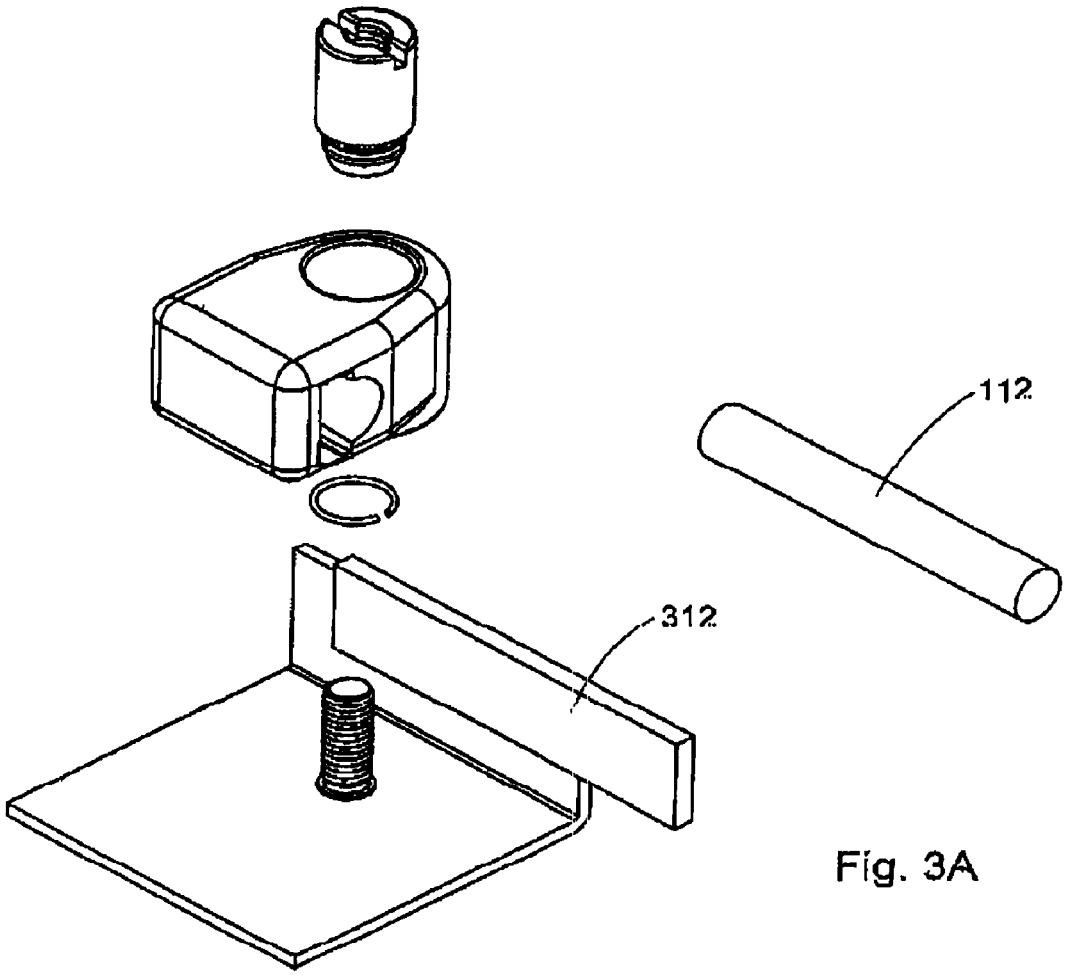
FIGS. 3A, 3B show an alternative embodiment form for a round bar or, alternatively, a ribbon bar in upright position.
Figure 3B:
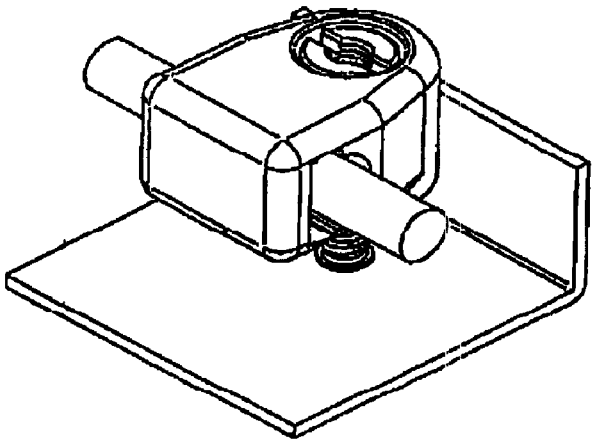
Figure 3D:
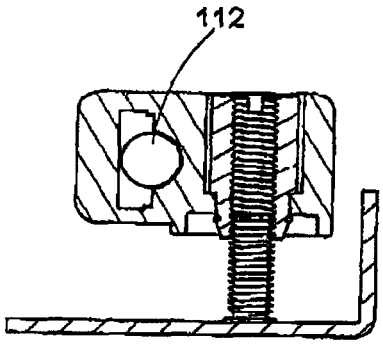
FIGS. 3C to 3F show views of the bar guide at different distances from the door leaf for a round bar and a ribbon bar, respectively.
Figure 3F:
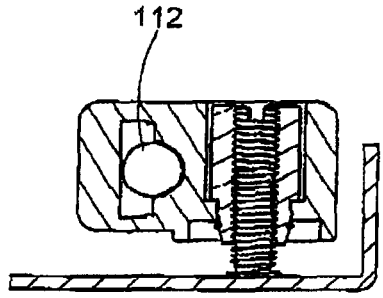
Figure 3C:
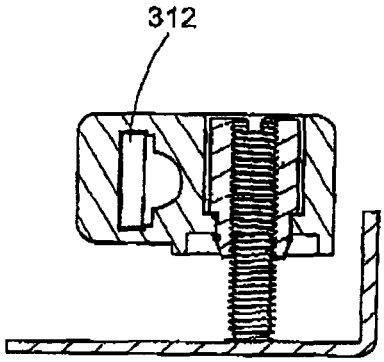
Figure 3E:
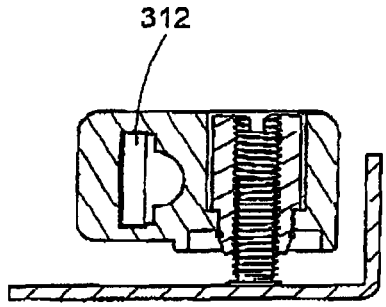
Figure 3G:
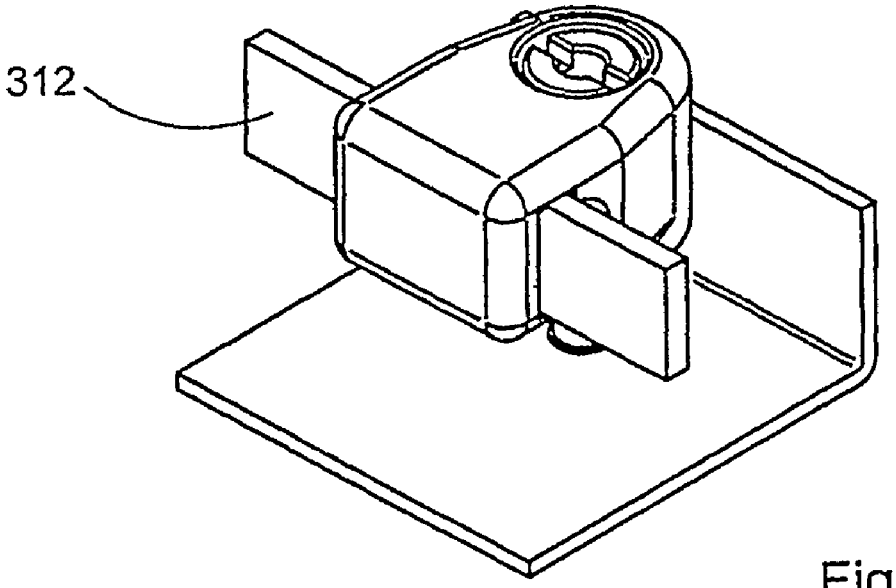
FIG. 3G shows a perspective view of the assembled bar guide according to FIG. 3A in connection with the ribbon rod in upright position.

In a corresponding manner, the distance of the locking bar 112 from the door leaf decreases as is shown in FIGS. 2C and 2E.

In the embodiment form shown in FIGS. 2A to 2E, the locking bar 112 can have a round shape, indicated in FIG. 2D by reference number 112, or a horizontal rectangular shape indicated by reference number 212.

The embodiment form shown in FIGS. 3A to 3G differs substantially from the embodiment form shown in FIGS. 2A to 2F in that the position of the locking bars 312 with rectangular cross section is perpendicular to the door leaf plane, while it lies parallel to it in the embodiment form shown in FIGS. 2A-2F.

Figure 4A:
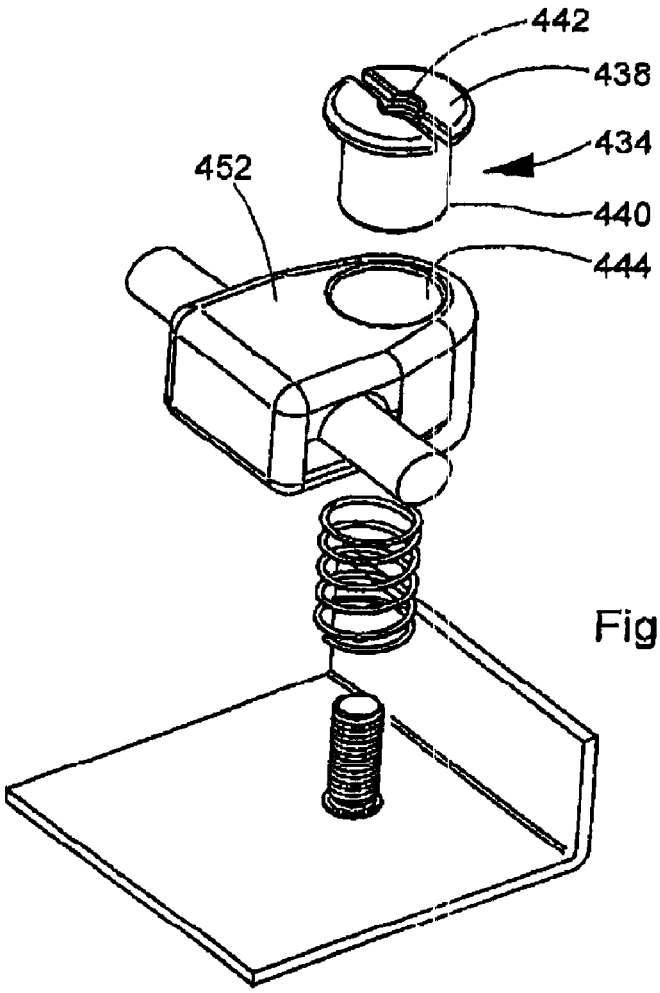
FIG. 4A shows another embodiment form with a pressure spring.
Figure 4B:
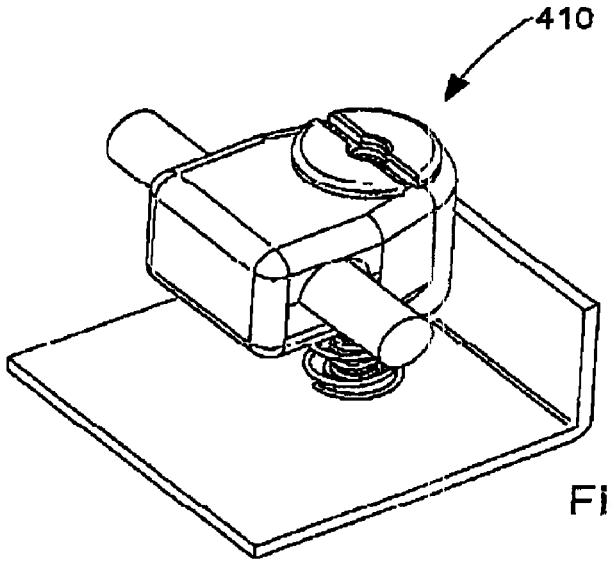
FIG. 4B shows the bar guide according to FIG. 4A in the assembled state fastened to the door leaf.
Figure 4D:
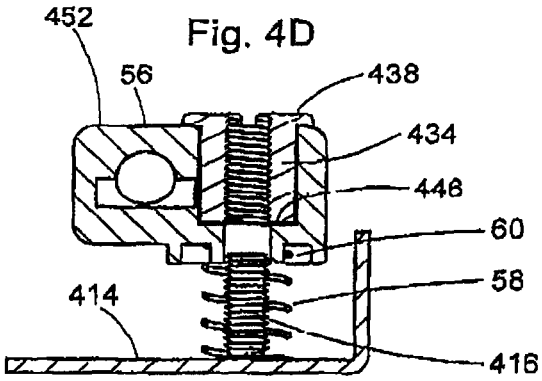
FIGS. 4C to 4F show plan views of the bar guide at different distances from the door leaf in a side view and in section.
Figure 4F:
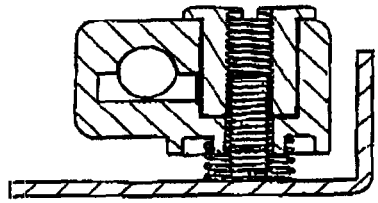
Figure 4C:
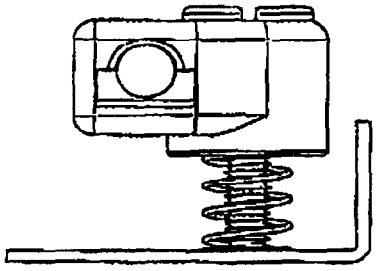
Figure 4E:
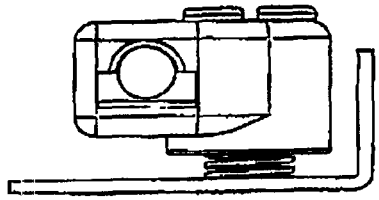

FIGS. 4A to 4F show another embodiment form in which the adjusting screw 434 is provided with a head 438 and a shaft 440 adjoining the latter and having a reduced diameter and an axial threaded through-hole or blind hole 442 for receiving the pin 416. The shaft 440 can be received by a bore hole 444 in the housing 452 and is supported on a shoulder 446 formed by the housing 452, which shoulder 446 is formed by the diameter reduction of the bore hole 444 or, alternatively, the head 438 is supported on the surface 56 of the housing 452 (see FIG. 4D). According to this embodiment form, the pin 416 is enclosed by a helical pressure spring 58 which is supported on the inside surface of the door leaf 414 on one hand and at the housing 452 on the other hand as is shown in FIGS. 4D to 4F.

The housing in the area of the spring support, see reference number 60, can have an annular projection or recess for receiving the end of the spring in a clamping manner.

The spring 58 replaces the retaining ring 50 and allows a movement of the bar guide 410 toward the door leaf 414 against the force of the spring 58.

Figure 5A:
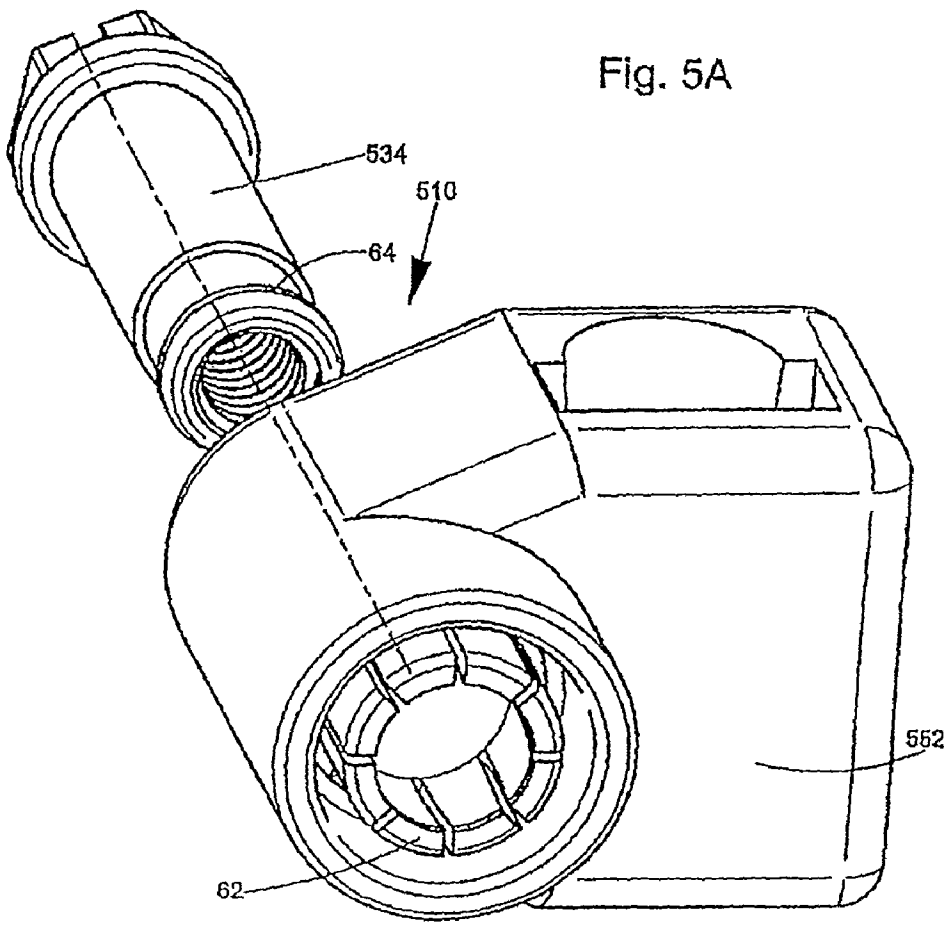
FIGS. 5A to 5F show various views of another embodiment form.

FIG. 5A shows a perspective view of a bar guide 510 for ribbon bars or for round bars 512 extending parallel to the door plane. In this bar guide 510, tongues 62 which enclose the adjusting screw or adjusting nut 534 proceed from the housing 552 and are anchored at a shoulder 64 formed by the adjusting screw 534 by a diameter reduction so as to prevent axial displacement or relative movement of the housing 552 on the adjusting nut 534.

Figure 5C:
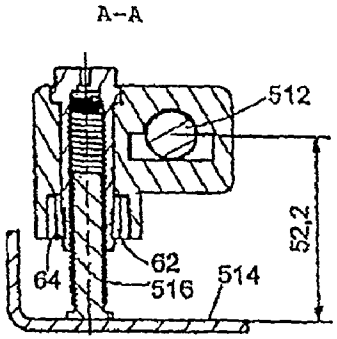
Figure 5B:
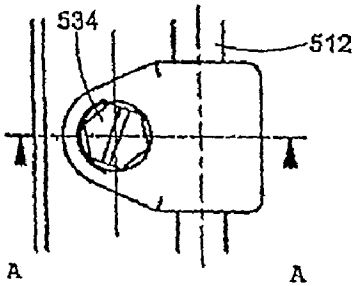
Figure 5D:
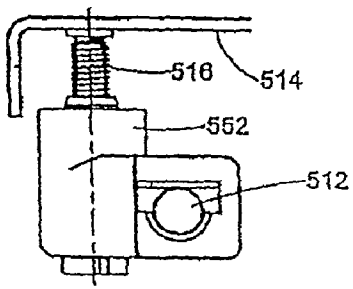

The adjustment of the distance 522 of the bar 512 from the door leaf plane 514 is carried out by turning the adjusting screw 534 on the pin 516 (plan view in FIG. 5B; sectional view along section line A-A of FIG. 5B in FIG. 5C; and side view of the bar guide 519 in FIG. 5D).

Figure 5E:
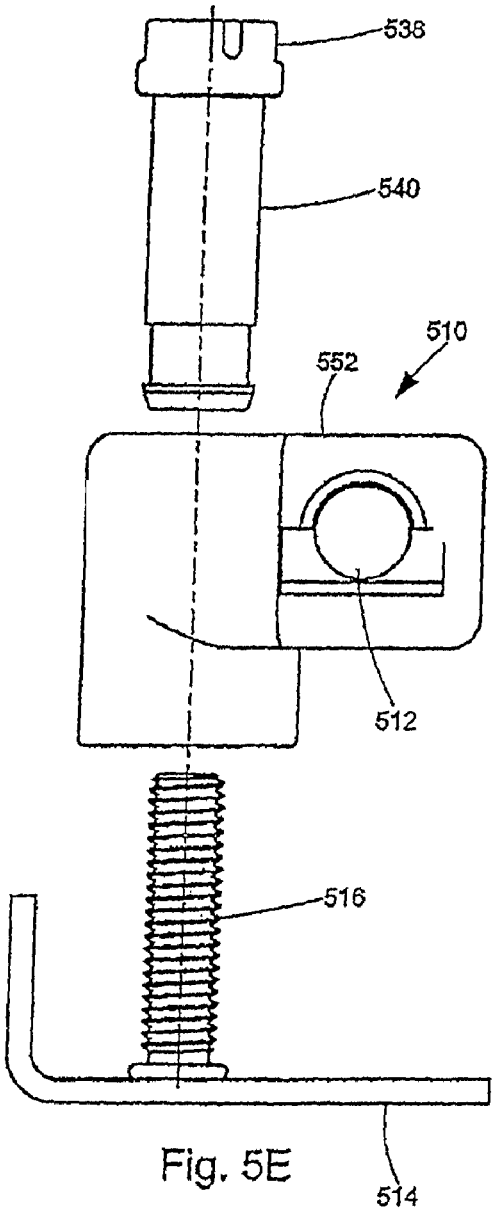
Figure 5F:
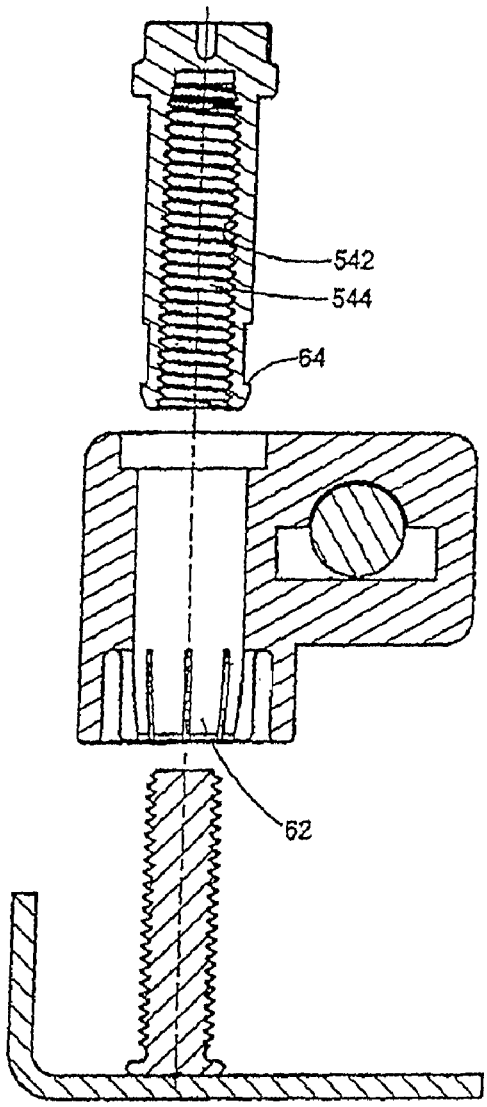

FIG. 5E shows an exploded side view, and FIG. 5F shows an exploded axial section through the arrangement according to FIGS. 5A to 5D.

Figure 6A:
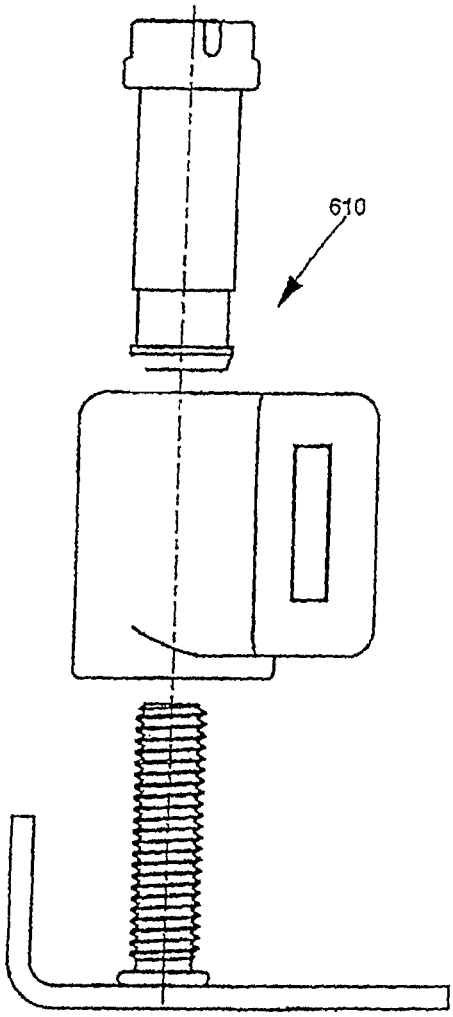
FIGS. 6A, 6B show a side view and an axial sectional view of another embodiment form.
Figure 6B:
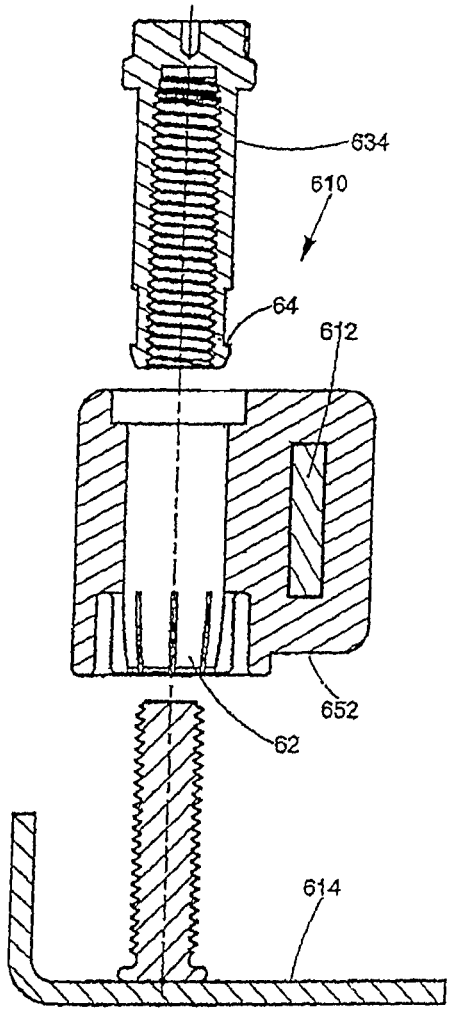

FIGS. 6A and 6B correspond to the views in FIGS. 5E and 5F for a bar guide 610 for ribbon bars 612 extending perpendicular to the door plane.

As is shown in the drawings, the housing 552 and 652, respectively, is injection molded from plastic integral with the tongues 62.

While this invention has been described in conjunction with the specific embodiments outlined above, it is evident that many alternatives, modifications, and variations will be apparent to those skilled in the art. Accordingly, the preferred embodiments of the invention as set forth above are intended to be illustrative, not limiting. Various changes may be made without departing from the spirit and scope of the inventions as defined in the following claims.

REFERENCE NUMBERS

10, 100, 410, 510, 610 bar guide
12, 112, 212, 312, 512, 612 locking bar
14, 114, 414, 514, 614 sheet metal cabinet door, door leaf
16, 116, 146, 416, 516 carrier, pin
18 guide element
20, 120 guide surface
22, 122, 522 distance
24 hole
26 alignment roller
28 seal
30 door frame
32 rear-engagement surface
34, 434, 534, 634 adjusting screw, adjusting nut
36, 136 guide channel
38, 438 head
40, 440 shaft
42, 442 threaded bore hole
44, 444 bore hole
46, 446 shoulder
48 area
50 retaining ring
52, 152, 452, 552, 652 block, housing
54 slot
56 surface
58 helical pressure spring
60 area
62 tongues
64 shoulder

The invention claimed is:

1. A bar guide for guiding locking bars on sheet metal cabinet doors, comprising: a carrier which is configured to be secured to the inside surface of a door leaf; and a guide element which is mounted on the carrier, and which has a guide surface whose distance from the inside surface of the door leaf is adjustable; wherein the carrier is a pin with a circumferential thread, and an adjusting screw or adjusting nut is screwed onto the pin; wherein the guide element is a housing which encloses the adjusting screw or adjusting nut, and which has a guide channel forming the guide surface for a locking bar; wherein the guide surface for the locking bar is configured to continuously contact at least half of a cross-sectional perimeter of the locking bar; wherein the adjusting screw or adjusting nut includes: a head; a shaft which adjoins the head, the shaft having a reduced diameter compared to the head; and an axial threaded through-hole or blind hole which receives the pin, such that the distance between the guide surface and the inside surface of the door leaf is adjustable; and wherein the head and the shaft are received, at least partially, by a first bore hole in the housing and the head is supported on a shoulder formed by the housing, this shoulder being formed by a diameter reduction of the first bore hole; and wherein the reduced diameter of the shaft of the adjusting screw or adjusting nut is sized with respect to the diameter reduction of the first bore hole in such a way that the adjusting screw or adjusting nut is retained in the housing with respect to rotation in the first bore hole.

2. The bar guide according to claim 1;

wherein a retaining ring is provided near the end of the shaft and, together with the shoulder, prevents axial movement of the adjusting screw or adjusting nut in the housing.

3. The bar guide according to claim 1; wherein the guide surface is formed by a second bore hole in the housing; and wherein the second bore hole is configured to receive the locking bar, which is a round or rectangular locking bar, in a sliding manner, the second bore hole being arranged perpendicular to and next to the first bore hole.

4. The bar guide according to claim 1; wherein the head is supported on a surface of the housing.

5. The bar guide according to claim 1; wherein tongues proceed from the housing which encloses the adjusting screw or adjusting nut, these tongues being anchored at a shoulder formed by the adjusting screw or adjusting nut by another diameter reduction portion of the shaft of the adjusting screw or adjusting nut, so as to prevent axial relative movement of the housing on the adjusting screw or adjusting nut.

6. The bar guide according to claim 5;

wherein the housing is injection molded from plastic, and the tongues are injection molded integral with the housing.

7. The bar guide according to claim 2; wherein the guide surface is formed by a second bore hole in the housing; and wherein the second bore hole is configured to receive the locking bar, which is a round or rectangular locking bar, in a sliding manner, the second bore hole being arranged perpendicular to and next to the first bore hole.

8. The bar guide according to claim 3; wherein tongues proceed from the housing which encloses the adjusting screw or adjusting nut, these tongues being anchored at a shoulder formed by the adjusting screw or adjusting nut by another diameter reduction portion of the shaft of the adjusting screw or adjusting nut, so as to prevent axial relative movement of the housing on the adjusting screw or adjusting nut.

9. The bar guide according to claim 4; wherein tongues proceed from the housing which encloses the adjusting screw or adjusting nut, these tongues being anchored at a shoulder formed by the adjusting screw or adjusting nut by another diameter reduction portion of the shaft of the adjusting screw or adjusting nut, so as to prevent axial relative movement of the housing on the adjusting screw or adjusting nut.

10. The bar guide according to claim 7; wherein tongues proceed from the housing which encloses the adjusting screw or adjusting nut, these tongues being anchored at a shoulder formed by the adjusting screw or adjusting nut by another diameter reduction portion of the shaft of the adjusting screw or adjusting nut, so as to prevent axial relative movement of the housing on the adjusting screw or adjusting nut.

* * * * *